US006324737B1

(12) United States Patent
Chamness et al.

(10) Patent No.: US 6,324,737 B1
(45) Date of Patent: Dec. 4, 2001

(54) CASKET WITH URN DRAWER

(75) Inventors: Clarence Chamness, Richmond; Barry Alvey, Lynn, both of IN (US)

(73) Assignee: The York Group, Inc., Houston, TX (US)

( * ) Notice: Subject to any disclaimer, the term of this patent is extended or adjusted under 35 U.S.C. 154(b) by 0 days.

(21) Appl. No.: 09/420,845

(22) Filed: Oct. 19, 1999

(51) Int. Cl.[7] ..... A61G 17/00
(52) U.S. Cl. ..... 27/2; 27/1
(58) Field of Search ..... 27/1, 10, 27, 2, 27/35

(56) References Cited

U.S. PATENT DOCUMENTS 4,324,026 * 4/1982 Craft .
4,457,054 7/1984 Craft et al. .
4,697,316 10/1987 Semon .
4,788,757 * 12/1988 Bethune et al. ..... 27/2
5,088,167 * 2/1992 Rahe ..... 27/1
5,611,124 * 3/1997 Biondo et al. .
5,675,876 * 10/1997 Benedict et al. ..... 27/2
5,704,103 * 1/1998 Crowley et al. .
5,727,291 3/1998 Biondo et al. .

OTHER PUBLICATIONS

American Cemetery, The Magazine of Cemetery Management, Jul. 1999, Table of Contents and pp. 30–31.
American Cemetery, The Magazine of Cemetery Management, Jul. 1999, Cover Page.

* cited by examiner

*Primary Examiner*—B. Dayoan
*Assistant Examiner*—William L. Miller
(74) *Attorney, Agent, or Firm*—Stevens, Davis, Miller & Mosher, L.L.P.

(57) ABSTRACT

A casket or coffin is provided with a drawer to receive an urn or other vessel containing ashes of a decedent.

5 Claims, 1 Drawing Sheet

CASKET WITH URN DRAWER

BACKGROUND OF THE INVENTION

1. Field of the Invention

A casket or coffin is provided with a drawer to receive an urn or other vessel containing ashes of a decedent.

2. Description of the Related Art

The use of caskets or coffins to contain a decedent's remains is an integral part of viewings, religious ceremonies and other funeral practices, especially military or state funerals. However, due to the scarcity of burial plots and/or the changing preference of decedents, their estates or their families, cremation is increasingly becoming more prevalent. Decedent's remains, in the form of ashes after cremation, are typically temporarily or permanently contained in an urn. Although such urns can be displayed at the aforementioned viewing, religious ceremonies and other funeral practices, the customary manner of displaying a casket or coffin during such events appears to be desirable among mourners, friends and family of the decedent.

There has heretofore been no manner in which to satisfy the customary display of a casket containing a decedent's remains in the form of ashes.

SUMMARY OF THE INVENTION

It is, thus, an object of the invention to provide a casket or coffin with a receptacle receiving enclosure to hold an urn or other vessel containing decedent's ashes after cremation in the casket or coffin.

It is a further object of the invention to provide a method of conducting a viewing, religious service or other funeral service, including military or state funerals, wherein a casket or coffin (hereinafter collectively "casket") containing a vessel for receiving decedent's remains in the form of ashes following cremation, is used in said method.

These and other objects of the invention will become apparent in connection with the following drawings and description of the invention.

DETAILED DESCRIPTION OF THE PREFERRED EMBODIMENTS

Figure 1:
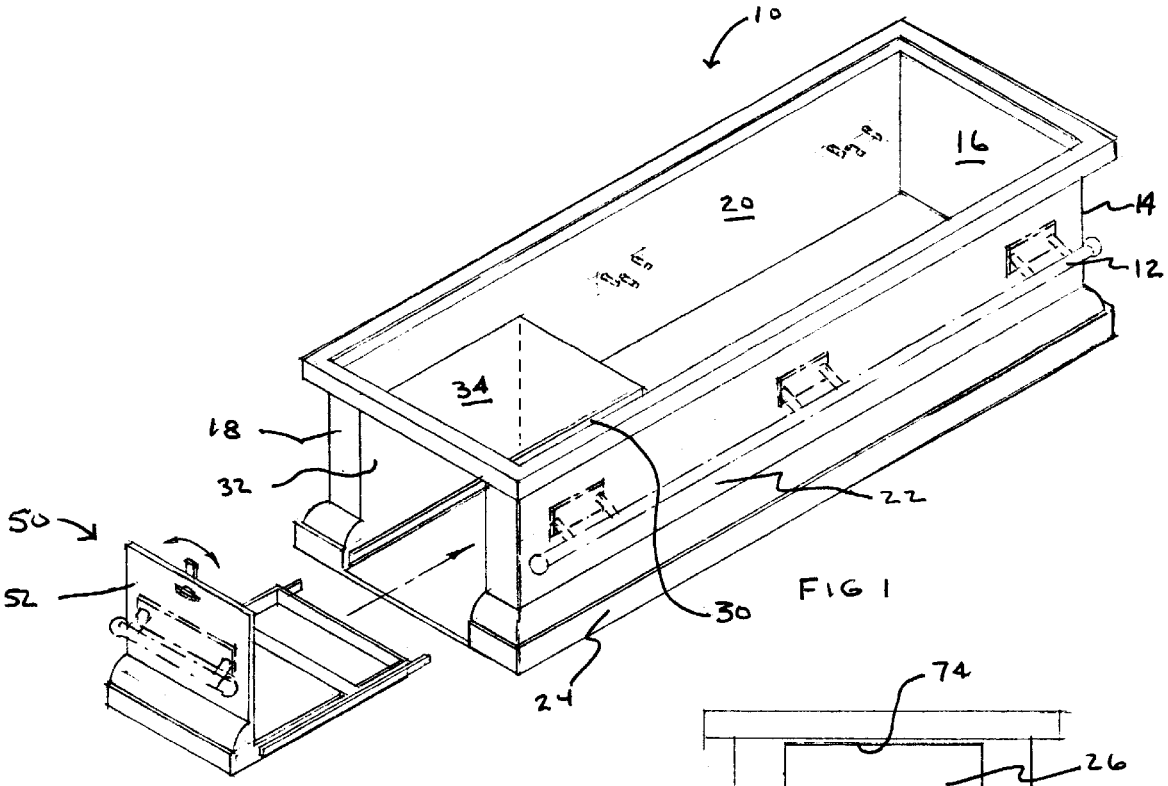
FIG. 1 is a perspective view of a casket (with the lid removed for illustrative purposes) defining a space for receiving a vessel containing a decedent's ashes following cremation.

Referring to FIG. 1 is shown a casket 10 (with the lid removed to show details of the interior of the casket 10). Casket 10 can be of generally familiar construction and may be made of wood, metal, or other materials conventional to construction of caskets. It may be provided with familiar finishes, including gun metal, gold tone and other high quality finishes suitable for use in military or state funerals. To this extent, the exterior of the casket may be provided with brass or other hardware 12; edge adornments 14, reminiscent of monument stair steps or other aesthetic features.

The casket 10 is of generally conventional structure having end walls 16, 18 and side walls 20, 22 mounted upon a decorative base 24. When made of metal, the end and side walls may be spot welded to the base.

Figure 2:
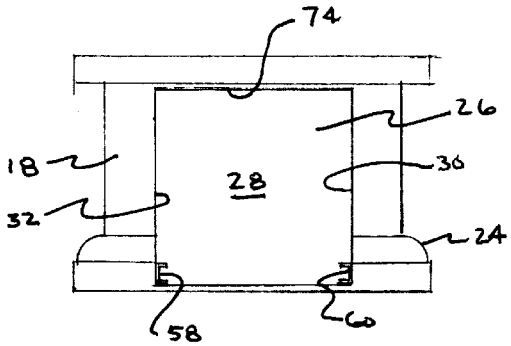
FIG. 2 is an end view of the casket of FIG. 1 showing the opening to the space.

End wall 18 of casket 10 differs from a conventional casket in that it is partially cut away exposing a space 26 (FIG. 2) within the interior of casket 10. Space 26 may be bounded by a back wall 28, side walls 30, 32 and optionally a top wall 34. Top wall 34 may be integral or removable from side walls 30, 32 and back wall 28.

Figure 3:
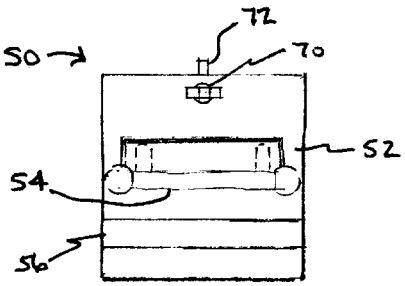
FIG. 3 is an end view of a drawer slidable relative to said space in said casket for conveying the vessel containing decedent's remains into said space.

A conveyor in the form of a relatively slidable drawer 50 (FIGS. 1, 3, 4) is provided upon which a vessel, such as an urn containing decedent's ashes, may be placed, so as to be conveyed by the relative movement of drawer 50 and casket 10. The exterior wall 52 of drawer 50 may be fashioned so as to match or compliment the finish on the remainder of casket 10. Additionally, the exterior wall 52 may be provided with matching brass hardware 54 so as to give the appearance that casket 10 is a conventional casket. In this regard, exterior base 56 of drawer 50 should match base 24 of casket 10 such that upon insertion of drawer 50 into space 26 the exterior of casket 10 imparts a pleasing unitary view of a conventional casket.

Figure 4:
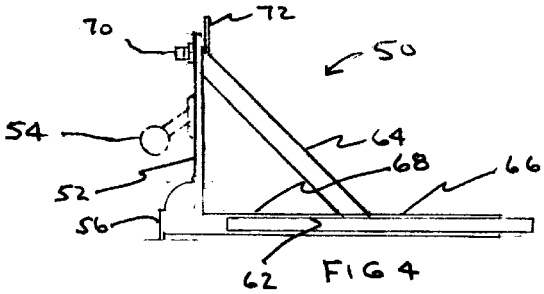
FIG. 4 is a side view of FIG. 3.

For purposes of facilitating the relative movement of drawer 50 with casket 10, rails 58, 60 may be provided to intersect with flanges 62 (only one of which is shown in FIG. 4, the reverse being a mirror image). Hardware, such as rollers, made of nylon or other polymeric material, can be used to facilitate relative movement. Other systems, such as telescoping track systems, or mechanical systems, such as used in file drawers of filing cabinets, can be adapted for use in the invention. If desired, braces 64 may be welded or otherwise fastened to maintain the orientation of exterior wall 52 and base 66 of drawer 50. Base 66 may be provided with an urn receiving lining 68 so as to cushion and support the urn (not shown) on base 66 of drawer 50. Even though urns have a low center of gravity and do not tend to tip, other means of supporting the urn will be apparent to those of ordinary skill in the art to prevent displacing the urn when casket 10 is moved, such as on a caisson or when hoisted onto the shoulders of pallbearers.

In use, the casket 10 is not meant to be interred but is considered reusable, once the vessel bearing decedent's ashes is removed from the casket 10. Thus, at the conclusion of ceremonial services, such as a military funeral, the casket can be reused for another service with the ashes of another decedent. When used in funeral homes, the casket 10 of the invention may be rented for a particular service.

In view of the fact that casket 10 is not meant to be interred, or even opened, no linings or adornments as are conventionally deployed in a casket need be provided. In such a case, the lid (not shown) may be permanently attached to casket 10, as by welding. Alternatively, it may remain locked. Spot welding of hardware, e.g. nuts and bolts, used to attach the brass hardware, or other fasteners, will provide long life to the casket 10 of the invention. A suitable locking mechanism 70 may also be provided on drawer 50 with a latch 72 mounted to engage a strike (not shown) on the upper surface 74 of the casket 10 so as to secure the remains of the decedent during the services, or in preparation therefore. The latch 72 may be mounted so as to be rotatable through an arc (as shown by the arrow in FIG. 3) between locked and unlocked positions.

Though, variations and modifications of the invention will be apparent to those skilled in the art, based on the description of certain preferred embodiments, those who are skilled in this area of technology will readily understand that various modifications and adaptations can be made without departing from the true scope and spirit of the invention. All such modifications and adaptations are intended to be covered by the following claims.

What is claimed is:

1. A casket for holding the remains of a decedent comprising a base, side and end walls and being provided with a space in said casket to receive an urn containing a decedent's ashes after cremation and one of said end walls being a drawer slidably receivable within said space to convey said urn into said space.

2. The casket of claim 1 further comprising a lid fixedly attached to the casket in a closed position.

3. A method of providing a casket or coffin for funeral services comprising:

providing said casket or coffin having a top, at least one end and side walls providing in said at least one end, a relatively moveable drawer;

placing an urn containing a decedent's ashes on the drawer in a position retracted from the coffin or casket;

conveying said urn into said coffin or casket by relatively moving said drawer into said coffin or casket;

displaying said casket or coffin containing said urn in a funeral service.

4. The method of claim 3 wherein the drawer is locked after said conveying step.

5. The method of claim 3 wherein the coffin or casket is reused to receive at least one other decedent's ashes.

* * * * *